US009922537B2

(12) United States Patent
Shah et al.

(10) Patent No.: US 9,922,537 B2
(45) Date of Patent: Mar. 20, 2018

(54) WEARABLE MULTI-SENSORY PERSONAL SAFETY AND TRACKING DEVICE

(71) Applicants: Tejas Girish Shah, Maharashtra (IN); Rasesh Hasmukh Shah, Gujarat (IN)

(72) Inventors: Tejas Girish Shah, Maharashtra (IN); Rasesh Hasmukh Shah, Gujarat (IN)

( * ) Notice: Subject to any disclaimer, the term of this patent is extended or adjusted under 35 U.S.C. 154(b) by 32 days.

(21) Appl. No.: 15/501,867

(22) PCT Filed: Dec. 5, 2013

(86) PCT No.: PCT/IN2013/000746

§ 371 (c)(1),
(2) Date: Feb. 6, 2017

(87) PCT Pub. No.: WO2015/019360

PCT Pub. Date: Feb. 12, 2015

(65) Prior Publication Data

US 2017/0229004 A1 Aug. 10, 2017

(30) Foreign Application Priority Data

Aug. 5, 2013 (IN) ..... 2562/MUM/2013

(51) Int. Cl.
*G08B 25/01* (2006.01)
*F41B 15/00* (2006.01)
(Continued)

(52) U.S. Cl.
CPC ..... *G08B 25/016* (2013.01); *F41B 15/00* (2013.01); *F41H 9/10* (2013.01); *F41H 13/0018* (2013.01);
(Continued)

(58) Field of Classification Search
CPC ..... G08B 25/016; G08B 13/1427; G08B 13/19621; G08B 15/00; G08B 15/004;
(Continued)

(56) References Cited

U.S. PATENT DOCUMENTS 5,515,419 A * 5/1996 Sheffer ..... B60R 25/102 340/539.1
5,559,520 A * 9/1996 Barzegar ..... G01S 5/0027 342/357.31
(Continued)

FOREIGN PATENT DOCUMENTS

EP 2553668 A1 2/2013

OTHER PUBLICATIONS

International Search Report of PCT Patent Application No. PCT/IN2013/000746 dated May 28, 2014.

*Primary Examiner* — Fekadeselassie Girma

(57) ABSTRACT

The present invention is a wearable, multi-sensory, personal safety and tracking device which predicts danger by sensing changes in voice, pulse, emotions, impact, motion of the wearer and the device state. In emergency situations, the device triggers SOS, alarm, electro shock, pepper spray and starts capturing images and audio recording for the safety of the wearer. For keeping a track of the wearer, the device connects to the internet using GPRS and sends the images clicked, the sound recorded and the GPS and GSM coordinates to the rescue team for gaining help for the wearer if needed. In the present invention, various technologies are integrated into one single wearable device thereby eliminating the need for purchasing and carrying multiple devices like pulse monitor, motion monitor, phone, camera, GPS module, self-defense tools, etc. thus saving money and providing comfort to the user.

13 Claims, 2 Drawing Sheets

(51) Int. Cl.
*F41H 9/10* (2006.01)
*F41H 13/00* (2006.01)
*G08B 15/00* (2006.01)
*G08B 15/02* (2006.01)

(52) U.S. Cl.
CPC ..... *G08B 15/00* (2013.01); *G08B 15/005* (2013.01); *G08B 15/02* (2013.01)

(58) Field of Classification Search
CPC .... G08B 21/0288; G08B 21/22; G08B 25/10; G08B 13/1436; G08B 13/19632; G08B 13/2402; G08B 13/2462; G08B 21/02; G08B 21/0211; G08B 21/0216; G08B 21/0275; G08B 21/0277; G08B 21/028; G08B 21/0446; G08B 21/0453; G08B 21/0461; G08B 21/0476; G08B 21/0484; G08B 25/009; G08B 27/001; G08B 3/1008; H04W 4/02; H04W 4/008; H04W 64/00; A61B 2562/0219; A61B 5/1112; A61B 5/0077; F41H 9/10; F41H 11/00; F41H 13/0018; G01S 5/0027; G01S 19/17; G01S 3/325; G01S 5/0009; G01S 5/0036; G01S 5/14; B60R 25/102; B64C 2201/066; B64C 39/024; G06F 19/3406; G06F 19/3418; G07G 3/003; G08C 17/02; G08G 1/205; H04L 12/1895; H04L 51/20; H04L 51/32; H04M 11/00; H04M 2250/12; H04M 3/5116; H04N 7/183
See application file for complete search history.

(56) References Cited

U.S. PATENT DOCUMENTS 5,742,233 A 4/1998 Hoffman et al.
7,733,224 B2 * 6/2010 Tran ..... G06F 19/3418 340/3.1
8,531,526 B1 * 9/2013 Spence ..... H04N 7/183 348/158
9,589,448 B1 * 3/2017 Schneider ..... G08B 25/016
2001/0026240 A1 10/2001 Neher
2002/0057915 A1 * 5/2002 Mann ..... E03C 1/057 396/661
2003/0071725 A1 * 4/2003 Teller ..... B67D 1/1405 340/539.1
2004/0174258 A1 * 9/2004 Edelstein ..... A61B 5/00 340/539.13
2006/0273916 A1 * 12/2006 Ortelle ..... G08B 15/001 340/574
2007/0222588 A1 * 9/2007 Wolfe ..... G08B 13/1427 340/539.13
2008/0169930 A1 * 7/2008 Mallinson ..... G06Q 30/02 340/573.1
2008/0186166 A1 * 8/2008 Zhou ..... G01S 5/0027 340/539.13
2010/0285771 A1 11/2010 Peabody
2011/0193704 A1 * 8/2011 Harper ..... A61B 5/14532 340/573.1
2012/0007735 A1 1/2012 Rhyins
2012/0138677 A1 * 6/2012 Ma ..... G07F 19/207 235/379
2012/0282887 A1 * 11/2012 Khoo ..... G08G 1/205 455/404.2
2012/0299711 A1 * 11/2012 Manning ..... G08B 15/02 340/321
2013/0231077 A1 * 9/2013 Cahill ..... H04W 4/22 455/404.2
2014/0145847 A1 * 5/2014 Jenkins ..... G08B 13/1427 340/572.1
2015/0206419 A1 * 7/2015 Johnson ..... G08B 25/009 340/936
2016/0192164 A1 * 6/2016 Scully ..... G08B 25/016 455/404.2
2017/0206763 A1 * 7/2017 Scully ..... G08B 25/016

* cited by examiner

WEARABLE MULTI-SENSORY PERSONAL SAFETY AND TRACKING DEVICE

FIELD OF THE INVENTION

The present invention relates to personal safety and tracking device which is wearable and can sense multiple features. This device has self-defence tools, SIM module, camera, GPS module, voice recorder, pulse monitoring, emotion sensor, impact sensor and others which provide safety to people carrying it and also keeps track of them.

BACKGROUND OF THE INVENTION

Since the stone-age, man has paid great attention to his safety and security. He used to live in cages and protect himself from unfavourable weather, natural calamities and wild animals by living in caves. While moving around he used to protect himself from wild animals or enemies using stones and sticks. As the primitive man evolved, he started using sharper weapons like sword, bow & arrow etc. to protect himself. When moving around alone in dense jungles or unknown places, man would keep track of himself by making signs on trees or spilling pebbles or such small things on the way he proceeded.

In this modern age too, man is concerned about his own and his near and dear ones' safety and security. With rising competition, enmity among people has also increased and sexual offences are also on the rise. Moreover, due to unemployment or other financial crises, many tend to wrong means for earning money which may include looting people, kidnapping them or causing different kinds of harms. Such incidents make people cautious and they keep worrying about their safety and security. With the development of science and technology, various inventions have been made to provide safety to individuals and keep a track of them.

U.S. Pat. No. 4,759,309 discloses a passive air, gas aerosol or pressurized fluid activated personal self-protection screech alarm device that is armed prior to the person utilizing it entering into a potentially dangerous area or situation. The primary and radically different feature of this device from those currently patented and/or on the market is that no action is demanded of the person carrying it in the event of an attack other than the natural inclination to release ones grip. Releasing ones grip on the aerosol can and lever and dropping the device then activates an irrevocable screech alarm. This device plays to the psychological implications of attack in that if active, overt action is taken by the person who is the subject of a rape, for example, the attacker oftentimes becomes more violent. With this device, the natural inclination to show fright and drop whatever one is carrying serves to activate the alarm. More particularly, when the device is released from the hand, a spring loaded lever (similar in feature to a military hand grenade) flies up and away from the can and becomes separated. That in turn releases a spring loaded fly-away plug valve allowing the propellant to escape and sound the alarm signaling portion of the device.

U.S. Pat. No. 5,635,908 relates to a portable audio apparatus having an alarm, electric stun and spray deterrent. Said primary and radically different feature of this device from those currently patented and/or on said market is that said self-protection devices are incorporated in a portable audio apparatus. This device allows said user to enjoy audio while having a feeling of security. Activation of said security system occurs by pulling said cord or releasing one's grip which will also pull said cord. Once activated, said present invention is in said constant on position. In said constant on position said alarm will sound and said electric stun will be operable. In addition, said present invention allows said user at any time to depress a trigger to release an eye irritant to resist an attacker.

U.S. Pat. No. 6,285,289 discusses a self contained, wearable personal protection device that incorporates a silent security alarm feature, a smoke detector alarm feature and, optionally, the feature of providing the time of day to the wearer is disclosed. The personal protection device with these features is incorporated into a housing case that is sized to be worn about the wrist of an individual user. The personal protection device is particularly suited for use by children. The smoke detector alarm feature of the device automatically activates an audible alarm feature when smoke is detected. The silent security alarm feature is activated when the wearer pushes a button on the device. Further, the wrist worn personal protection device optionally provides the wearer with the time of day as a further incentive for the child to wear the device.

U.S. Pat. No. 7,015,817 discloses a system for monitoring the location of individuals, such as parolees, includes a wearable device worn by the individual and a portable device operatively coupled to the wearable device. The portable device is operatively coupled to a monitoring system through a wireless telephone network. The portable device transmits periodically encrypted location information as well as status information across the wireless network to the monitoring system. The monitoring system tracks the location of the individual and alerts the appropriate authorities when the individual violates a rule, such as a condition for parole. The portable device increases the time between transmissions when the individual is within a specified home location and reduces the time between transmissions when outside the specified location.

U.S. Pat. No. 7,173,526 gives a security and surveillance system for aircraft on the ground incorporates a plurality of strategically spaced sensors including video imaging generators, audio sensors, motion detectors, and fire and smoke detectors for monitoring critical components and critical areas of both the interior and the exterior of the a commercial transport such as an aircraft. The system is a comprehensive multi-media safety, tracking and/or surveillance system, which provides both visual and/or audio information as well as critical data such as location, direction, intrusion, fire and/or smoke detection and/or status of environmental conditions and/or asset systems status. The collected information is analyzed and prioritized according to type of event, location and nature of required response for automatically dispatching the proper response. The captured data and images are transmitted to a ground based security station for display on a monitor and may be recorded on a "black box" recorder as well as on a ground based recording system.

U.S. Pat. No. 8,195,192 describes a portable tracking device integrating a mobile phone module (e.g. based on GSM or 3G networks), a GPS module, a radio Beacon and ultrasonic beacon. The tracking device is normally in a hibernated state when the entire device consumes little energy and require no periodically changing or recharging batteries to power the device. It consumes power from the primary battery only when a tracking process is actually taken place. With this portable tracking device on the person who is unable to affirmatively report his or her whereabout, the remote center and/or a search team can communicate the GPS module, radio beacon and ultrasonic beacon of the tracking device via the mobile phone module based on existing wireless communication technologies, such SMS, GPRS, etc., on GSM or 3 G networks, which also serves as a means of initial rough estimation of the tracking device's location.

US Patent Application 20020108966 discusses an apparatus disguised as a flashlight to be used as a self protection device. This apparatus includes a housing ergonomically designed to fit a user's hand. Included in the housing are a battery, a low battery indicator device, a lighting device, a chemical spray canister, a shocking primary electrode and an additional shocking electrode, each component having a trigger assembly. The primary electrodes are triggered by a trigger switch. The additional electrode is triggered by applying force on the electrodes. The apparatus is used to either shoot the chemical spray at an assailant at a distance, or use the shocking primary electrode at a close distance, if the assailant is in front of a victim. When the assailant is at the back of the victim, the bottom additional electrode is activated for use while at the same time deactivating the shocking primary electrode. The personal safety device has a safety device that can disable the personal safety device when it is pulled from a user.

US Patent Application 2007063851 displays a personal advance warning system in the form of a portable, wearable device, the system being adapted to detect and alert the wearer of a possible threat to his/her safety. The system employs an array of infrared sensors to detect body heat from humans or animals at a distance of approximately fifteen feet, which provides a buffer zone to give a wearer time to make a decision as to the authenticity of the threat and to avoid sudden surprise. Integrated circuitry converts signals from the sensors into an audible warning and a text message. The text message indicates the location and the type (human or animal) of the potential threat. Each sensor of the array is located in a different area on the device.

US Patent Application 2012007735 describes a wearable personal tracking device that can communicate over a cellular network. The device includes a wrist mounted part, having a wristband and a clasp which holds the wristband on to the wrist of a user. The housing holds a position detecting part which detects the position of a user who is wearing said wrist mounted part, and a cellular transceiving part which communicates information including said information via the cellular network, e.g., via G3 cellular internet connectivity. The device automatically produces an alarm based on a position of the user when in a monitoring mode.

WO 2013050763 is a monitoring device for monitoring an individual is disclosed, comprising a main body for attachment to a person to be monitored. The device further comprises a technology system comprising a controller and/or a receiver, a sensor, and a transmitter, one or more security devices within the main body and/or the attaching means for hindering removal of the belt or attachment means from the person to be monitored. Alerting means are included for alerting a remote monitoring system or individual about unauthorised removal of the device or interference with the electronics, the attaching means or another element of the device. Means for alerting the remote monitoring system or individual about the welfare of the individual to be monitored or interactions of the individual to be monitored with their surrounding environment are provided and the device may interact with a home of the user as part of a system to control and/or monitor the living environment of the user.

WO 2013041735 describes an invention which lies in the field of tracking and monitoring persons, more specifically in possible emergency situations with the need to locate said persons in a possible circumstance. The subject matter of the invention consists of an electronic device having different communication, localization and state monitoring means which work together in a coordinated manner such that the device can be configured to detect risk situations and to send an alarm signal to an alarm centre without the need for active intervention by the user carrying the device.

EP 1803319 relates to a method and device for communicating with a person in distress comprising the steps of: providing a communication device (1); initiating an event in said communication device (1) for opening a two-way communication link with a monitoring entity (404); starting a camera (20) and display unit (40) on said communication device (1); transmitting communication signals between said communication device (1) and said monitoring entity (404); transmitting position data of and images from said communication device (1) to said monitoring entity (404).

CN 102822879 is an apparatus and method for a tracking device to inconspicuously track a person to be monitored (such as a child or at-risk adult) are presented. Some embodiments of the present invention combine a positioning receiver (e.g., a GPS receiver) and a locking mechanism to act as a tracking device, which attaches to an article of clothing or fabric wearable by the person to be monitored. Some embodiments of the present invention keep a positioning receiver and a radio frequency identification tag (RFID tag) or other RF tag, which are physically separate but in RF proximity of each other.

CN 201854375 provides a security monitoring integrated machine combined with wireless communication technology, computer processing and infrared sensing technology, which has an SOS function and is suitably used in different places. The integrated machine comprises a system main controller, a communication module, a serial interface for a peripheral device, a synchronous dynamic random access memory, a keyboard, an image sensor, a passive infrared detector, a memory and a microprocessor. The security monitoring integrated machine can achieve far distance real-time communication monitoring, realizes the functions of random snapshot and real-time transmission in the form of sending and receiving short messages and MMS (Multimedia Messaging Service) through the communication module, and has a broad application prospect.

CN 201936414 is an intelligent monitoring system belongs to a regional security monitoring field with a high intellectualization, and comprises an image information acquisition system, an intelligent tracking system and an early warning system. An image information database built by the image information acquisition system can improve an ability of identifying images coming from the outside of the region. The early warning system can quickly focus on abnormal events and abnormal actions within a monitoring range inside or outside the region. The intelligent tracking system of the intelligent monitoring system can restrain an occurrence probability of the abnormal events inside the region effectively, and simultaneously, actual monitoring blind spots are avoided, powerful image evidences are provided for a following dispose of the abnormal events, and the regional security is guaranteed to greatest extent. Problems that abnormal events can not be found promptly and the actual blind spots exist in a fixed-point monitoring, which are caused by inevitable neglects due to an excessive dependence on labor monitoring existing in the existing regional security monitoring system, are solved, and the intelligent monitoring system has the advantages of high intellectualization, no blind spots, safety, reliability and the like.

Indian Patent Application 427/KOL/2006 is a real time pervasive tracking, monitoring and management system involving wireless and mobile technologies. Importantly, the system of the invention advantageously involves wireless mesh network infrastructure comprising of a small, universal, battery-powered safe RF devices to locate, trace and manage mobile assets and people. The system would have various types of end uses and applications involving tracking and managing mobile assets and people, such as, tracking of movement of persons in sensitive and high risk zones such as, in mines to improve the safety of miners and improving their surveillance especially in the event of an emergency and favouring mine rescue operations as well as tracking of movement of high value assets and its movement management to achieve increased assets utilization and prevention of unauthorized access in stores. Advantageously, the system of the invention can further enable detection of environmental and/or other sensitive industrial or natural conditions and the like in various locations thus ensuring safety of persons and property.

Although some safety and security devices are available in the prior art and a few related to tracking using GPS; a multisensory wearable personal safety and/or tracking device that is capable of local and/or remote and automatic and/or manual storage capacity and/or activation which employs alert, assist and/or attack mechanisms to counter situations of emergency, problems or need faced by the wearer of the device is the need of the day.

OBJECT OF THE INVENTION

The main object of the invention is to provide for a wearable, multi-sensory, personal safety and tracking device with automatic sensing module for sensing changes in but not limited to voice, pulse, emotions, impact, motion and the device state.

Another object of the invention is to provide for a wearable, multi-sensory, personal safety and tracking device which can manually be adjusted to sense local and remote changes.

Still another object of the invention is to provide for a wearable, multi-sensory, personal safety and tracking device which uses tracking modules like GPS, GPRS, Satcom etc.

Yet another object of the invention is to provide for a wearable, multi-sensory, personal safety and tracking device which uses local and remote storage modules like server or cloud to store data and pictures.

A further object of the invention is to provide for a wearable, multi-sensory, personal safety and tracking device whose charging module can use plugged, solar or electro-mechanical energy.

A still further object of the invention is to provide for a wearable, multi-sensory, personal safety and tracking device which has a processing and display module to activate, deactivate or control various modules.

A yet further object of the present invention is to provide for a wearable, multi-sensory, personal safety and tracking device which uses smart algorithm to avoid false alarm.

A still another object of the present invention is to provide for a wearable, multi-sensory, personal safety and tracking device which has trigger module for alerting through SOS signals and alarm.

A yet another object of the present invention is to provide for a wearable, multi-sensory, personal safety and tracking device which has module for photo, audio and video recording and can play back the recorded data.

A yet further object of the present invention is to provide for a wearable, multi-sensory, personal safety and tracking device which has self-protection modules for attack which include electric shock, pepper spray and blunt object.

SUMMARY OF THE INVENTION

The present invention is a wearable, multi-sensory, personal safety and tracking device in which the device checks for input events like manual switch press or remote triggering of the device along with automatic inputs like changes in voice, pulse, accelerometer, impact or other sensory inputs which may predict emergency or problematic conditions like but not limited to sexual assault/abuse, domestic violence, accidents, fire, drowning, robbery, thefts, kidnapping, abduction, brutality on the streets, violence, medical emergencies like heart attacks, trauma and many more medical and non-medical problems and emergencies. If the situation is confirmed as an emergency event, the device triggers the various modules which include sending SOS and activating the siren in the alert module; GPS module, GSM module, camera, local sound recording, recorded sound playing and others in the assist module; activating the electric shock, pepper spray and attack with a blunt object in the attack module. In the presence of the internet, the GPS and GSM coordinates, images and recordings are sent by e-mail, SMS and/or MMS to the rescue team as well as the remote server is updated. In the absence of internet, if network is available, SMS and/or MMS is sent to the rescue team and the copies of coordinates, images and recordings are stored locally as evidence. This way the device is very helpful in safety and tracking and helps a person during emergencies as well as is helpful to police and investigating agencies.

DETAILED DESCRIPTION

The nature of the invention and the manner in which it is performed is clearly described in the specification. The invention has various components and they are clearly described in the detailed description.

Life sometimes catches you by surprise whether at home or on the move and this surprise may not always be a pleasant one. Emergencies and problems can occur anytime to anyone, be it a close one who enjoys jogging in the evenings, hiking and walking in remote areas, a teenager living away from home, kids having frequent outings and late nights, elderly parents with medical conditions staying home alone, partner working late nights, pet animals who have strayed, other important and precious non-living objects or any other activity that could compromise safety. Such emergencies include but are not limited to:

Sexual assault/abuse
Domestic violence
Accidents, fire, drowning, etc
Robbery and thefts
Kidnapping, abduction, etc
Brutality of the streets
Medical emergencies like heart attacks, trauma, etc
Violence in general And many more medical and non-medical problems and emergencies One should always remain prepared for such situations. When dangers, emergencies & problems are commonplace, one should make safety a priority and should choose safety solutions as an integral part of living.

The present invention tracks and protects people in such conditions. It helps people to stay safe when needed and enables them to live more independently with greater confidence, peace of mind and dignity when they are at their homes or outside. With the present invention help becomes available to people 24×7×365 at the press of a button. It solves major problems in field of personal safety & tracking. The present invention integrates various modules of safety and tracking in a device which is a multisensory wearable personal safety and/or tracking device that is capable of local and/or remote and automatic and/or manual storage capacity and/or activation which employs alert, assist and/or attack mechanisms to counter situations of emergency, problems or need faced by the wearer of the device. This device is simple, lightweight, waterproof, weatherproof, embeddable, highly reliable, low cost, low power and elegant having least carrying resistance. The present invention also has provisions for storage of data in the memory of the device which is available in the form of micro SD card, SSD and others.

Figure 1:
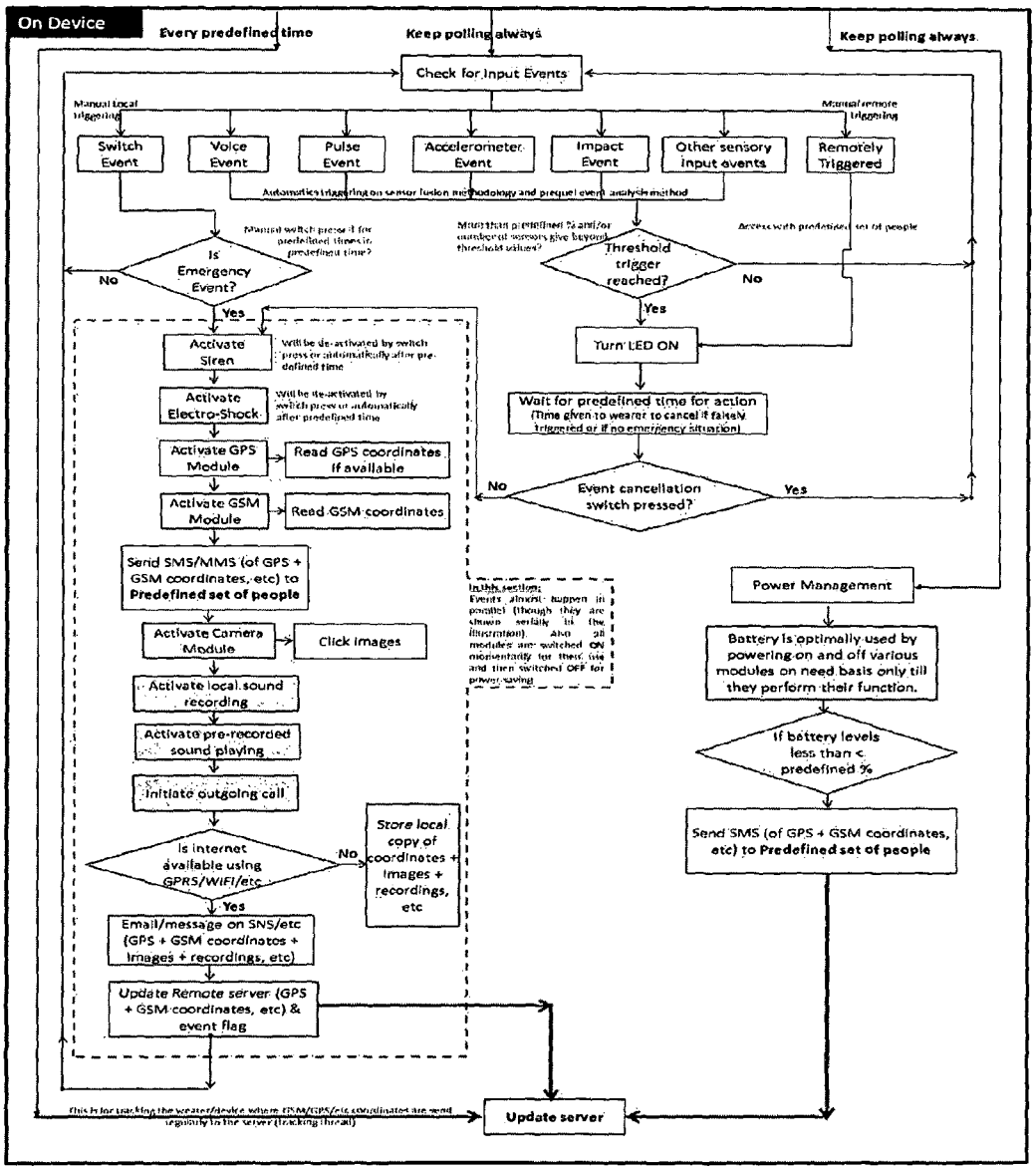
FIG. 1 gives the flow-chart of the working of the present invention on the device FIG. 2 gives the flow-chart of the working of the present invention on the server and shows the server-client tracking

The present invention is a wearable device which when working keeps track of the wearer continuously. This device updates the location of the wearer on the remote secure server. The wearer needs to update on the website, a predefined set of contacts which includes details of relatives, rescue team and other persons who need to be contacted in cases of emergencies which may include among other details, their contact phone numbers, their e-mail ids and other information that would assist in contacting them. The functioning of the device is shown in the flow chart displayed in FIG. 1.

At every predefined time interval, say every 5 minutes, the device checks for a number of input events like but not limited to manual switch press, changes in voice, changes in the pulse, accelerometer changes, impact changes on the wearer and other sensory input events. If 50% or more of the above mentioned sensors show abnormal values, the situation is considered as an emergency situation by the device.

The device can also be manually triggered by the wearer, by pressing the switch predefined times, say 3 times or more in less than a predefined time, if some emergency is observed. If some or any one of the above events predict some kind of danger, the device will consider it to be an emergency event.

In case the contacts need to find the location or trigger emergency from remote location, the can do so by using an interface provided to them online. A particular use of this would be where the contact is talking to the wearer (on phone) and somehow senses that s/he is in problem. This event when triggered by the contact is also considered as emergency event.

In an emergency situation, the device triggers the various modules. The modules of this device are divided into three main modes which include the alert mode, the assist mode and the attack mode each of which has various modules.

The alert mode includes sending SOS like but not limited to call, SMS, e-mail, MMS and posting on social networking internet services and activating the siren. The siren can be switched off manually if there isn't any danger and the alarm is false and it automatically switches off after a predefined time.

The assist mode includes the GPS module, GSM module, camera, local sound recording, recorded sound playing and others. Here the device activates the GPS and GSM modules to read their coordinates. The GPS and the GSM modules are put to sleep after its momentary functioning. The GPS and GSM modules, when active, send SMS, e-mail, MMS and post on social networking internet services to the entire rescue team. Along with all the above mentioned modules, the device also activates the camera module which starts clicking images and the local sound recording module which starts the local audio recording. The camera and the sound recording module are put to sleep after their momentary functioning. If there is some sound recorded in the device like help or any such recording starts playing and outgoing call is initiated in the device. If internet is available at the location of emergency, using GPRS, the GPS and GSM coordinates and the images and audio recordings are e-mailed to the predefined set of contacts but if the wearer is in a place where internet is unavailable, all the data is stored in the device in the memory of the device which is available in the form of micro SD card, SSD and others for later accession. In the presence of the internet, the e-mail sent is also updated on the remote server and an event of emergency is flagged.

The attack mode includes activating the electric shock, pepper spray and attack with a blunt object. The device activates electro-shock in cases of emergencies which gives an electric shock to the attacker. This electro-shock can be deactivated manually if there isn't any danger or automatically gets deactivated after the predetermined time. The attack mode also includes activating the pepper spray for spraying pepper on the attacker and attacking the attacker with a blunt object.

Great care has been taken to ensure that the false alarms are not raised on a regular basis. For e.g. pulse going high during regular sexual intercourse etc., or normal conversations having words like "help" etc. To do this, the device uses sensor fusion methodology and prequel event analysis method. Once any sensor issues interrupt after sensing values beyond threshold, other sensors are checked continuously for abnormalities for predetermined time. Post this time, the LED on the device blinks for predetermined time to give the wearer a chance to manually shut it off by pressing the button/switch on the device. After that, a message is passed to the toll-free safety call center of the device. The call center arranges for a call in a predetermined time to talk to the wearer to check if everything is fine. If the call center finds the device or cell phone unreachable for say 3 attempts in the predetermined time, it sends a message to the predefined set of contacts and local police.

In case of emergency, if the wearer wants to bypass all the aforementioned steps, he needs to press the manual switch 3 times. This action immediately sends messages to the call center, the police and the predefined set of contacts. The contacts of the wearer are available for each user on the cloud (which is the website on internet) where he can edit contact details. The contacts too can view the location of the wearer which is updated and saved every 5 minutes.

In the present invention, battery life of the device is very important as the device may need to remain active for longer time durations without being recharged. The smart algorithm in the device ensures that the battery is optimally used by powering on and powering off various modules on need basis only. For e.g., the camera module is provided with power only after it is triggered so that it remains asleep for most of the time thus saving power. Similar is the case with GPS/GPRS module which is activated every 5 minutes or on trigger. The rechargeable battery can be recharged using solar power or mechanical or electrical or any other known recharging techniques.

The present invention efficiently manages power as the battery is optimally used by powering on and off various modules as per their requirements only till their functioning is required. If the device has battery charging less than 20%, an SMS of the GPS and GSM coordinates is sent to the call center. In the absence of any event, the server is updated after every predetermined time periods, say 5 minutes.

In the present invention, if the input events do not predict an emergency, the device checks whether the threshold trigger is reached. If it isn't reached, the device again goes in the dormant stage and checks for input events again after every predetermined time periods. But if the threshold trigger is reached, then the LED is turned on through remote triggering. This LED is kept on for a predetermined time, say 10 seconds waiting for some action by the user. If the user presses the event cancellation switch, the device understands that there isn't any emergency and so goes back in the dormant stage. But if the user doesn't press the event cancellation switch, the device predicts an emergency situation and starts performing the requisite functions. The device activates a siren to alarm nearby people which can be switched off manually if there isn't any danger and the alarm is false. It also automatically switches off after the predetermined time. The device also activates electro-shock in cases of emergencies which too can be deactivated manually if there isn't any danger or automatically gets deactivated after the predetermined time. Along with this it also activates the GPS and GSM modules to read their coordinates. The GPS and the GSM modules are put to sleep after its momentary functioning. The GPS and GSM modules, when active, send SMS to the entire rescue team. Along with all the above mentioned modules, the device also activates the camera module which starts clicking images and the local sound recording module which starts the local audio recording. The camera and the sound recording module are put to sleep after their momentary functioning. If there is some sound recorded in the device like help or any such recording starts playing and outgoing call is initiated in the device. If internet is available at the location of emergency, using GPRS, the GPS and GSM coordinates and the images and audio recordings are e-mailed to the rescue team but if the wearer is in a place where internet is unavailable, all the data is stored in the device by overwriting on the next trigger of the device for later accession. In the presence of the internet, the e-mail sent is also updated on the remote server and an event of emergency is flagged.

Figure 2:
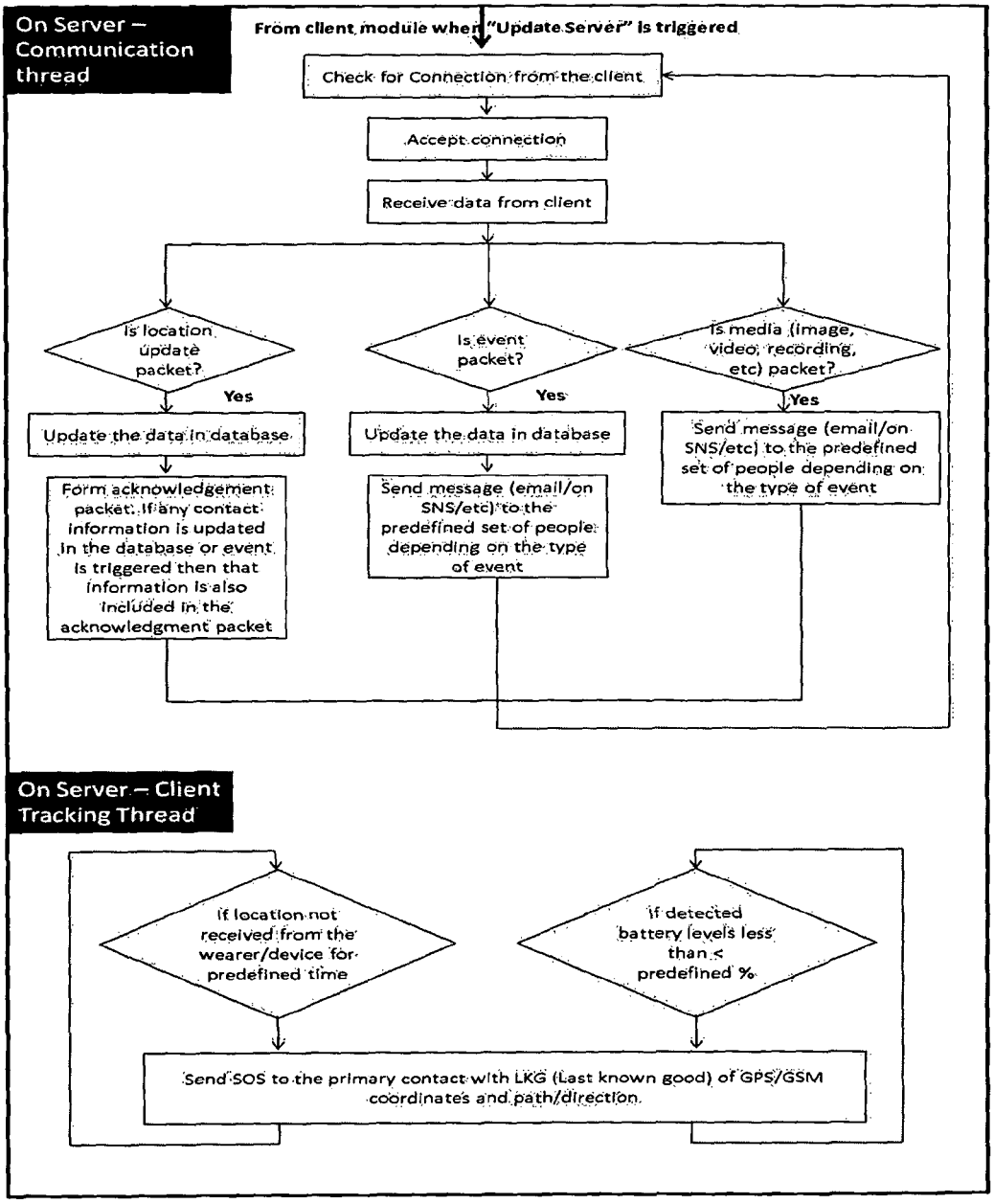

In the present invention, all the above actions occur on the wearable device. From the device which is the client module when "Update Server" is triggered, then the server-communication thread proceeds as shown in FIG. 2. The server first checks for connection from the client. After accepting the connection, the server receives data from the client. If there is a location update packet, the data is updated in the database in the form acknowledgement packet. If any contact information is updated in the database or event is triggered, that information is also included in the acknowledgement packet. If there is event packet, the data is updated in the database and e-mail is sent to the rescue team which may include the primary contact or all the contacts depending upon the type of event. If there is image data packet, image is sent to the predefined set of contacts as e-mail. In all these cases the server keeps a check of the connection with the client.

FIG. 2 also displays the server-client tracking thread according to which if the location of the wearer is not received from the device for more than predetermined time, say 2 hours, a SOS is sent to the primary contact with last known details of the GPS/GSM coordinates and the last known path/direction. Similarly if the detected battery level of the device is less than 20%, then too a SOS is sent to the primary contact with last known details of the GPS/GSM coordinates and the last known path/direction.

This way the present invention is a safety and tracking device which keeps a track of the wearer and protects him/her in emergency situations. Even when the wearer is untraceable, remote triggering of the device can be done by the predefined set of contacts, due to which the server sends warning signals to the rescue team to search for the wearer. The device also manages power by low consumption of power and switching off various modules of the device whenever not in use. Even when the battery level of the device is less, the server keeps track of it and intimates the primary contact.

The present invention is highly advantageous as it is a wearable, waterproof, weatherproof, lightweight, reliable and simple personal safety & tracking device. In the present invention, various technologies are integrated into one single wearable device thereby eliminating the need for carrying multiple devices like pulse monitor, motion monitor, phone, camera, GPS module, self-defense tools, etc., that individually would not be a part of the life style of various sets of people like kids, old age people etc. This reduces the cost by eliminating the need to purchase various devices and the discomfort caused if multiple devices have to be carried along with them to perform the functions performed by the present invention. Besides this, individual devices would not interface and interact with each other to give a complete sense of security like the camera if carried separately wont update images when clicked without manual intervention or e-mails won't be sent to predefined set of contacts automatically in case of emergencies.

Moreover the present invention has good power handling capabilities with smart software. The device has the ability of auto sensing problematic situations and providing safety in such situations like activating the alarm, activating the electro shock and others. The device can also manually be triggered in cases of emergency by the wearer due to the presence of manual units as backup. It can be locally or remotely activated. The device also has the facility for local and remote storing of sensory and tracking data which can be retrieved and used for analysis. The present invention has smart algorithms for reliable triggering such that the various modules of the device are triggered only during emergencies. The infrastructure for communication is also integrated and complete without any flaws. The present invention has various product lines and business models for different market segments. The customer support concept of the present invention is also of the latest kind for real time monitoring.

Although the preferred embodiment as well as the method and use have been specifically described, it should be understood that variations in the preferred embodiment could be achieved by a person skilled in the art without departing from the spirit of the invention. The invention has been described with reference to specific embodiment which is merely illustrative and not intended to limit the scope of the invention as defined in the claims.

We claim:

1. A wearable, multi-sensory, personal safety and tracking device enabled to monitor one or more events and trigger alerts during emergency situations, comprising:

a plurality of automatic sensing modules for sensing changes in voice, pulse, emotions, impact, motion and the device state and capturing the changes sensed in form of sensed data;

a GPS module and a GSM module enabled to capture location co-ordinates of the device at predefined time intervals;

a camera module and a local sound recording module for recording photo or images or pictures, audio and video and further to play back the recorded data;

a memory coupled with a server or a cloud to store the sensed data and the recorded data;

a charging module enabled with a plugged connection, solar or electro-mechanical energy;

a processing module to process the sensed data and the recorded data for detecting an emergency event, wherein the processing module detects the emergency event based upon detecting an interrupt signal from an automated sensing module, the interrupt signal indicating that a sensor value captured by the said automated sensing module has reached a predefined threshold value, continuously monitoring sensor values from remaining automated sensing modules for predetermined time to check whether the sensor values captured from the remaining automated sensing modules has reached to respective predefined threshold values, confirming presence of the emergency event based upon the detection of the sensor values captured from one or more of the remaining automated sensing modules being reached to respective predefined threshold values;

an alert module triggered to activate a siren and for alerting through SOS signals and alarm over a network to devices belonging to a plurality of contacts and on one or more social networking platforms after the detection of the emergency event, wherein the alert module is triggered either manually or automatically;

a plurality of self-defence tools for attack which comprises an electric shock, a pepper spray and a blunt object as attacking means.

2. The wearable, multi-sensory, personal safety and tracking device of claim 1 wherein, the processing module is enabled to check input events comprising one or more of manual switch press, changes in voice, changes in the pulse, accelerometer changes, impact changes on the wearer and other sensory input events at predetermined time intervals.

3. The wearable, multi-sensory, personal safety and tracking device of claim 1 wherein, the device is either locally triggered by the wearer or remotely triggered by the users belonging to predefined set of contacts manually in cases of emergencies.

4. The wearable, multi-sensory, personal safety and tracking device of claim 1 wherein, in an emergency situation, which has been detected automatically or has been triggered manually, the processing module is enabled to:

(i) activate a siren to alarm nearby people, wherein the siren activated is switched off manually in case of false alarm or is automatically switched off after predetermined time;

(ii) activate an electro-shock, wherein the electro-shock activated is deactivated manually in case of false alarm or is automatically deactivated after predetermined time;

(iii) activate the GPS module and GSM module to read the location coordinates, wherein the GPS module and the GSM module are put to sleep after momentary functioning;

(iv) send SOS messages in the form of SMS, e-mail, MMS and posts on social networking internet services to a rescue team;

(v) activate the camera module for capturing images and the local sound recording module which starts the local audio recording, wherein the camera module and the local sound recording module are put to sleep after momentary functioning;

(vi) start playing sound recorded in the device and initiates outgoing call;

(vii) send e-mail of the GPS and GSM coordinates and the images and audio recordings to the rescue team through the internet using GPRS; and (viii) stores the data in the device, in the absence of the internet and/or connectivity.

5. The wearable, multi-sensory, personal safety and tracking of claim 1 wherein, the processing module manages power by powering on and off the plurality of modules as per requirements.

6. The wearable, multi-sensory, personal safety and tracking device of claim 1, wherein, if the device has battery charging less than 20%, an SMS of the GPS and GSM coordinates is sent to the call center.

7. The wearable, multi-sensory, personal safety and tracking device of claim 1 wherein, the device is enabled to go to dormant stage if the predefined threshold value is not reached for any of the plurality of automated sensing modules, and wherein the processing module continues to check for input events from the automated sensing modules after a predetermined time.

8. The wearable, multi-sensory, personal safety and tracking device of claim 1 wherein, an LED is activated for predetermined time waiting for input action by the user during which if the event cancellation switch is pressed, the device goes back in the dormant stage and if the event cancellation switch is not pressed, the device predicts an emergency situation.

9. The wearable, multi-sensory, personal safety and tracking device of claim 1 wherein, the server checks for connection from the client and after accepting the connection, the server receives data from the client.

10. The wearable, multi-sensory, personal safety and tracking device of claim 1 wherein, if there is a location update packet, the data is updated in a database in the form of acknowledgement packet along with the updating of the contact information or the triggering of an event if any.

11. The wearable, multi-sensory, personal safety and tracking device of claim 9 wherein, if there is an event packet, the data is updated in the database and e-mail is sent to the rescue team which may include the primary contact or all the contacts depending upon the type of event.

12. The wearable, multi-sensory, personal safety and tracking device of claim 9 wherein, if there is image data packet, the image is sent to the registered contacts as e-mail.

13. The wearable, multi-sensory, personal safety and tracking device of claim 1 wherein, if the location of the wearer is not received from the device for predefined time, a SOS is sent to the primary contact with last known details of the GPS/GSM coordinates and the last known path/direction.

* * * * *